United States Patent [19]

Mullen

[11] Patent Number: 4,848,058

[45] Date of Patent: Jul. 18, 1989

[54] RECREATION SURFACE AND TILE INTERLOCKING SCHEME

[75] Inventor: Paul A. Mullen, Loysville, Pa.

[73] Assignee: Carlisle Tire & Rubber Company, Carlisle, Pa.

[21] Appl. No.: 209,551

[22] Filed: Jun. 21, 1988

[51] Int. Cl.[4] ..... E01C 5/18; E04C 2/26

[52] U.S. Cl. ..... 52/585; 52/605; 52/607; 404/40

[58] Field of Search ..... 52/384, 607, 233, 578, 52/585, 821, 827, 828, 785, 605, 606; 404/40, 32, 33

[56] References Cited

U.S. PATENT DOCUMENTS

| | | | |
|---|---|---|---|
| 302,943 | 8/1884 | Rockwood . | |
| 921,114 | 5/1909 | Hudson | 52/585 |
| 1,504,313 | 8/1924 | Barnes | 404/40 |
| 1,555,922 | 10/1925 | Johnson . | |
| 3,315,427 | 4/1967 | Frye | 52/607 |
| 4,227,829 | 10/1980 | Landry, Jr. | 405/20 |
| 4,294,051 | 10/1981 | Hughes, Jr. | 52/585 |

FOREIGN PATENT DOCUMENTS

| | | | |
|---|---|---|---|
| 185106 | 3/1956 | Austria | 52/826 |
| 6602 | 8/1874 | Canada | 404/40 |
| 1362514 | 4/1964 | France | 52/578 |
| 251608 | 1/1927 | Italy | 404/40 |
| 79865 | 6/1952 | Norway | 52/821 |
| 558889 | 2/1975 | Switzerland | 52/585 |
| 457177 | 11/1936 | United Kingdom | 404/40 |
| 606987 | 8/1948 | United Kingdom | 52/821 |
| 955156 | 4/1964 | United Kingdom | 52/607 |

*Primary Examiner*—Michael Safavi

*Attorney, Agent, or Firm*—Wood, Herron & Evans

[57] ABSTRACT

The present invention relates to a recreation surface which consists of a plurality of resilient tiles, each of which has through bores for receiving elongated tie rods and side slots for receiving tie bars which have apertures therein. The through bores are intersected by the side slots such that when the tie bars are inserted into confronting slots in adjacent tiles the apertures in the tie bars are aligned with the through bores and are fixed against relative movement when the tie rods are inserted.

4 Claims, 3 Drawing Sheets

RECREATION SURFACE AND TILE INTERLOCKING SCHEME

BACKGROUND OF THE INVENTION

This invention relates to a new recreational surface, and more particularly to a scheme for interlocking the tiles which make up the recreational surface.

Statistics from the United States Consumer Product Safety Commission indicate that the majority of playground-related injuries are caused when children fall from equipment and strike the underlying surface. Nearly half the injuries that result from falls are to the head, and range in severity from minor bruises to skull fractures, concussions, brain damage, and even death. Studies indicate that, while they may require little maintenance or repair, hard surfacing materials such as asphalt and concrete do not provide adequate injury protection from accidental falls and are therefore unsuitable for use under playground equipment. Another type of surface which is commonly used around playground equipment is a layer of loose material such as bark nuggets, bark mulch, shredded bark or cocoa shell mulch. The cushioning potential of these materials depends upon the air trapped within and between the individual particles. Therefore, when the materials decompose or become pulverized over a period of time, or mix with dirt, they tend to lose their cushioning effect. Cushioning protection also decreases in rainy or humid weather when the materials absorb moisture and become packed down, or if the temperature drops and the wet materials freeze. Furthermore, because strong winds can erode these materials, thereby reducing the thickness available to protect against injury, and because the playing action of children can push the protective materials away from fall areas, frequent grading and leveling are necessary to maintain sufficient depth to provide the necessary protection.

Certain other types of loose materials, for example, sand, pea gravel and shredded tire rubber, are also used around playground equipment. As with the previously mentioned surfacing materials, however, these materials also require frequent leveling to replace material that is pushed or blown away from fall areas, and grading or sifting to remove foreign matter. Also, moisture tends to make these materials more cohesive and therefore less cushioning. For example, sand loses virtually all resiliency when it becomes wet.

Another category of surfacing materials includes outdoor rubber mats, foam rubber gym mats and synthetic turf. Generally, the cushioning properties of these materials will depend upon the foundation or surface over which the material is installed. Although surface materials of this type require very little maintenance, they are oftentimes the subject of vandalism, such as removal or displacement.

SUMMARY OF THE INVENTION

The present invention is directed to a recreation surface which is made up of a plurality of resilient rubber tiles that possess superior shock-absorbance and are suitable for use around playground equipment. The present invention is more particularly directed to a scheme for interlocking the tiles and fixing them in place which significantly reduces the opportunity for vandals to remove or displace the tiles.

In accordance with the general principles of the present invention, there is disclosed herein a recreation surface consisting of a plurality of resilient tiles arranged in a two-dimensional array of columns and rows which are fixed against relative movement in directions parallel to those columns and rows and also perpendicular thereto. Each tile has through bores for receiving elongated tie rods and the through bores of each tile ar aligned with those of each other tile in any given column to form continuous through bores. Additionally, each tile has slots in its side edges for receiving tie bars which are disposed in the confronting slots of adjacent tiles in each row. The side slots intersect the through bores and the tie bars have apertures therein which are aligned with the through bores such that the tie bars are engaged by the tie rods which pass through the bores.

In a preferred form, the recreation surface of the present invention consists of a plurality of resilient tiles made of rubber crumbs bound together with a suitable binding material, for example, polyurethane, and molded into generally square tiles. For purposes of this description, the tiles as described are square; however, it should be appreciated that tiles of various other shapes may be advantageously employed for recreation surfaces as described herein. The tiles are molded and have a substantially uniform overall thickness, as defined by upper and lower surfaces, and front, rear, right and left side edge surfaces. Each tile has at least two longitudinal through bores molded therein during the molding process which extend from the front side edge surface to the rear side edge surface. It should be appreciated that the through bores may be drilled or otherwise formed in the tiles by a method other than molding. One bore, the left through bore, is adjacent to and substantially parallel with the left side edge surface, while the other bore, the right through bore, is adjacent to and substantially parallel with the right side edge surface.

In addition, a plurality of slots are molded (or otherwise formed) into each tile. Preferably, each tile has four slots molded therein—two left side slots and two right side slots. The first left side slot is adjacent the front side edge surface and extends parallel thereto from the left side edge surface a distance sufficient to intersect the left through bore. The second left side slot is adjacent the rear side edge surface and extends parallel thereto from the left side edge surface a distance sufficient to intersect the left through bore. The first right side slot is adjacent the front side edge surface and extends parallel thereto from the right side edge surface a distance sufficient to intersect the right through bore. Finally, the second right side slot is adjacent the rear side edge surface and extends parallel thereto from the right side edge surface a distance sufficient to intersect the right through bore.

Thus, in a preferred square tile, there is a through bore located adjacent the right side edge surface and a through bore located adjacent the left side edge surface, each through bore extending from the front to the rear side edge surface and each bore intersected in two places by slots which extend perpendicular to the bore from the respective side edge surfaces.

In addition to the above, the tiles may have a peripheral expansion lip adjacent their upper surface which extends around the perimeter of the tile. The expansion lip is relatively thin and narrow as compared to the tile as a whole and deforms during periods of expansion of the tiles to prevent buckling of the entire recreation surface. Furthermore, the tiles may have a plurality of "cores" therein which add resiliency, reduce the amount of materials needed per tile and reduce the weight of each tile. These cores can take a variety of forms including dimples in the bottom surface and channels of any suitable cross-section through the tile.

The recreation surface of this invention comprises a plurality of tiles, as described, arranged in an a two-dimensional array of perpendicularly directed columns and rows. The tiles are arranged in edge-to-edge, abutting relationship such that the longitudinally extending through bores all run in the same direction and form a parallel array of continuous through bores. That is, in any given column of tiles there is a continuous left through bore and a continuous right through bore formed from the individual left and right through bores in each tile in that column. When a plurality of tiles are arranged in an array of columns and rows, the left side slots of each tile in a given row (except the leftmost tile) are in confronting, abutting relationship with the right side slots of the left-adjacent tile. Similarly, the right side slots of each tile in a given row (except the rightmost tile) are in confronting, abutting relationship with the right side slots of the right-adjacent tile.

The invention further comprises a plurality of tie bars, preferably rectangular, which have at least two apertures therein. The tie bars are adapted to fit within the confronting left and right side slots such that the apertures in the tie bars are aligned with the respective right and left through bores in each tile. Once each tie bar is positioned in a confronting pair of slots, elongated tie rods, which extend beyond the length of the column, are inserted in the continuous left and right through bores in each column. The elongated tie rods engage the tie bars by passing through the apertures therein; they hold the adjacent tiles in edge-to-edge, abutting relationship; and they prevent lateral displacement of the tiles in a direction parallel to the rows of tiles. Finally, the ends of the elongated tie rods are immobilized and concealed so as to prevent longitudinal displacement of the tiles in a direction parallel to the columns of tiles. The tiles are also inhibited from displacement in direction perpendicular to the upper surface of the tiles. Once the recreation surface of the present invention is fixed in place, it is virtually impervious to removal or displacement by vandals.

BRIEF DESCRIPTION OF THE DRAWINGS

FIG. 7(A)-(C) shows several embodiments of tiles with coring.

DETAILED DESCRIPTION OF THE INVENTION

Figure 1:
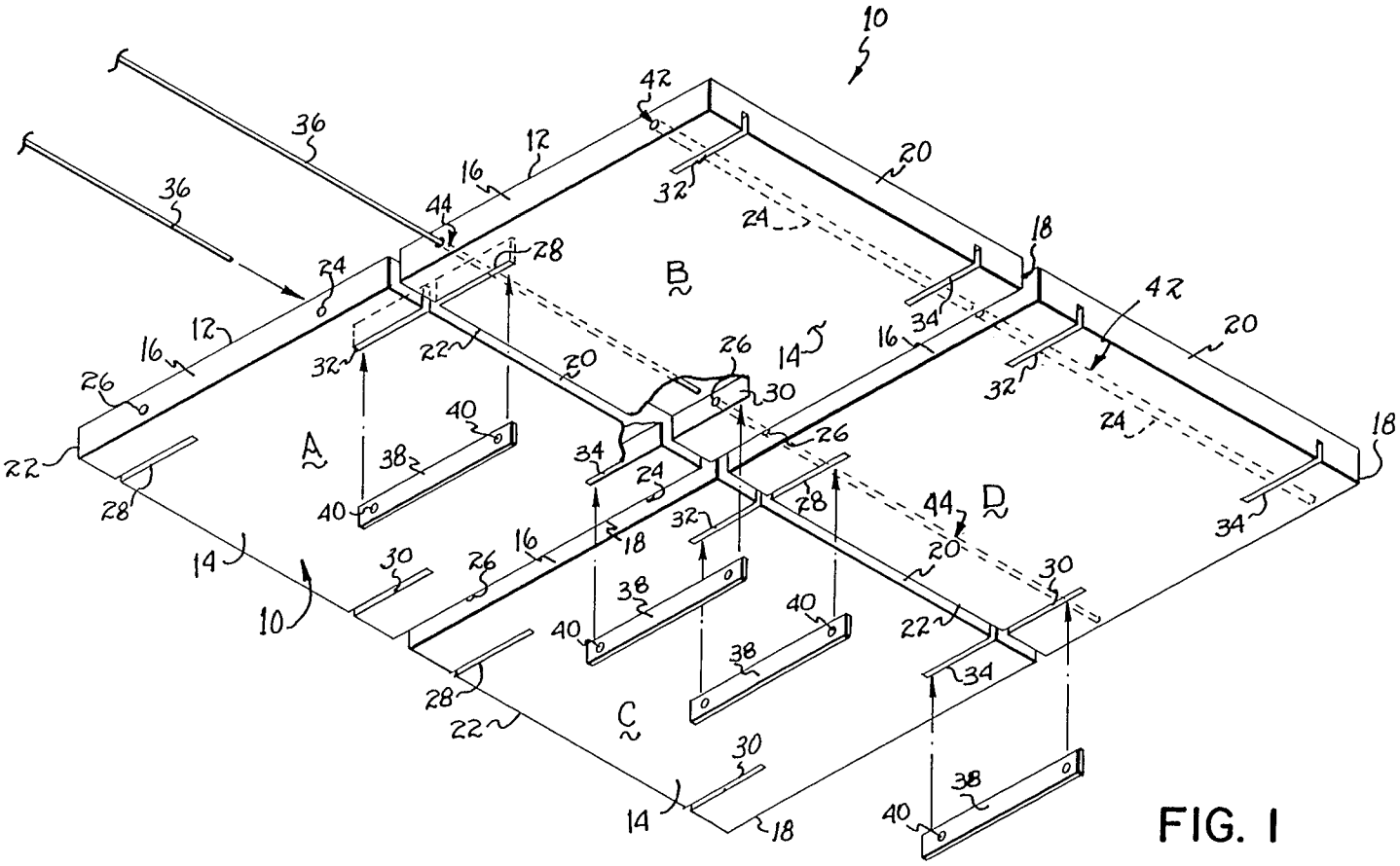
FIG. 1 is an isometric view from the bottom to the top showing four tiles and the interlocking means in exploded view.
Figure 2:
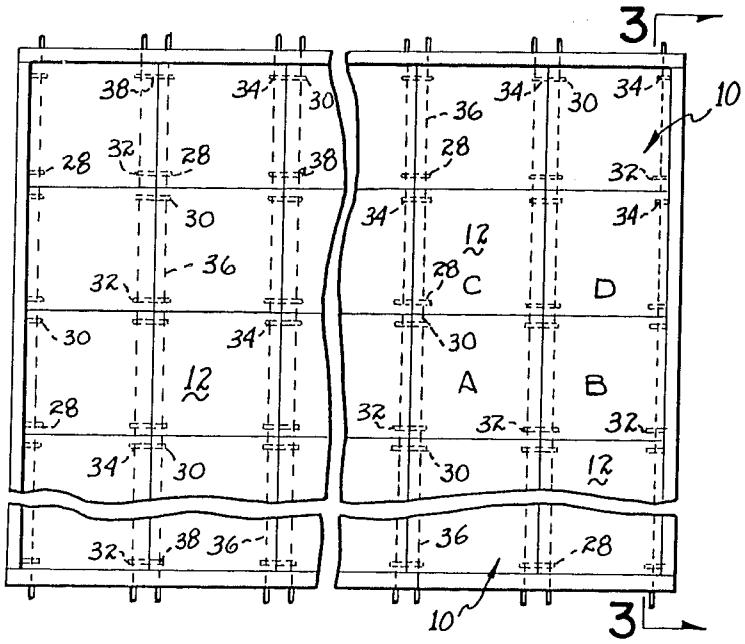
FIG. 2 is a top view of a two dimensional array of tiles.

FIG. 1 shows an isometric view of four tiles and the interlocking means which is used to hold the tiles in abutting, edge-to-edge relationship. Each tile 10 has a upper surface 12 and lower surface 14 which define its thickness in the vertical direction. In addition, tiles 10 have front 16, rear 18, right 20 and left 22 side edge surfaces further defining the tile. Each tile has a first through bore 24 and a second through bore 26 which extend from front edge surface 16 to the rear edge surface 18. As shown in FIG. 1, first through bore 24 is adjacent to and substantially parallel with right side edge surface 20 and second through bore 26 is adjacent to and substantially parallel with left side edge surface 22. In addition, each tile 10 has first and second left side slots, 28 and 30, respectively, and first and second right side slots, 32 and 34, respectively. First left side slot 28 is adjacent to and substantially parallel with front side edge surface 16 and extends from left side edge surface 22 a distance sufficient to intersect second bore 26. Similarly, second left side slot 30 is adjacent to and substantially parallel with rear side edge surface 18 and extends from left side edge surface 22 a distance sufficient to intersect second bore 26. First right side slot 32 is adjacent to and substantially parallel with front side edge surface 16 and extends from right side edge 20 a distance sufficient to intersect first bore 24. Second right side slot 34 is adjacent to and substantially parallel with rear side edge surface 18 and extends from right side edge 20 a distance sufficient to intersect first bore 24.

Figure 4:
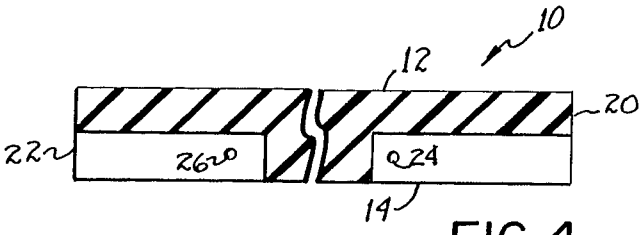
FIG. 4 is a cross-section of one embodiment of the side slots in a tile.
Figure 5:
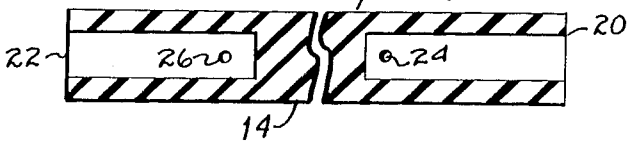
FIG. 5 is cross-section of an alternative embodiment of the side slots in a tile.

As shown in FIGS. 1 and 4, the side slots 28, 30, 32 and 34 in each tile are positioned such that each slot opens to either the right 20 or left 22 side edge surface and the bottom surface 14. However, in an alternative embodiment shown in FIG. 5, the side slots 28, 30, 32 and 34 may be positioned such that each slot opens to either a left 22 or right 20 side edge surface only. In either embodiment, the slots are positioned substantially below the upper surface 12 such that there is substantial thickness of resilient material between the slots and the upper surface 12.

The tile interlocking scheme further comprises a plurality of tie bars 38 which fit engagingly in confronting side edge slots when tiles 10 are arranged in an array of columns and rows. As shown in FIG. 1, tiles A-B and C-D form partially complete rows of tiles and tiles A-C and B-D form partially complete columns of tiles. In this configuration, the left side slots, 28 and 30, of each tile in each row are in confronting relationship with right side slots, 32 and 34, of each left adjacent tile in the same row. Likewise, right side slots, 32 and 34, of each tile in each row are in confronting relationship with left side slots, 28 and 30, of each right adjacent tile in each row. In addition, first and second through bores, 24 and 26, respectively, in each tile in each column are aligned and form first and second continuous bores, 42 and 44, in each column of tiles.

Figure 3:
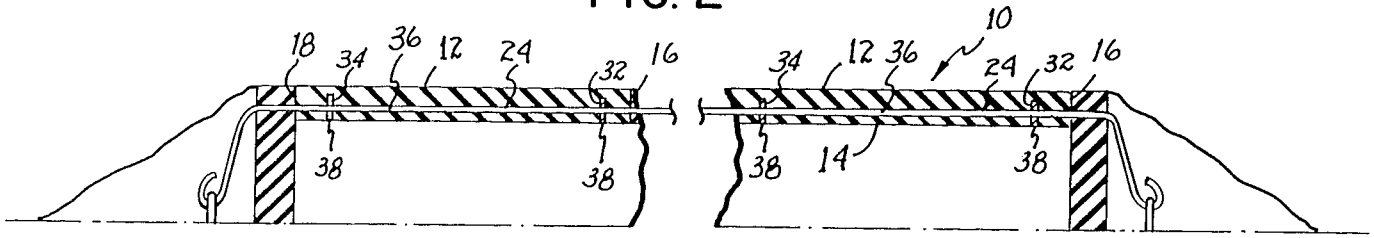
FIG. 3 is a cross-sectional view taken in lines 3—3 of FIG. 2 of a recreation surface in its environment.

Tie bars 38 have apertures 40 therein which are aligned with first and second through bores 24 and 26 when the tie bars 38 are disposed in the confronting right and left side slots in each row of tiles. Thus, when elongated tie rods 36 are inserted in continuous bores 42 and 44 in each column, the adjacent tiles in each row are held in abutting, edge-to-edge relationship. Elongated tie rods 36 extend the entire length of each column of tiles and their ends are secured to the ground by any suitable means. For example, they can be embedded in a cement footing or held in place with a spike which is embedded in the ground and covered (as shown in FIG. 3).

Figure 6:
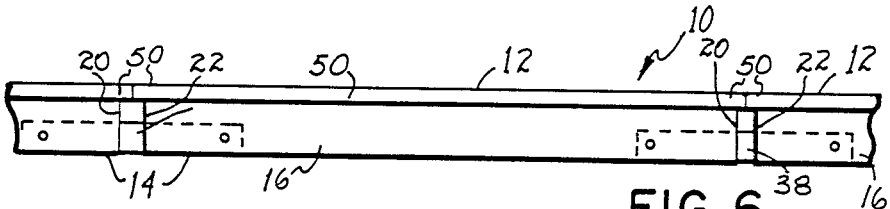
FIG. 6 is a side view of confronting tiles which have peripheral expansion lips.
Figure 7A:
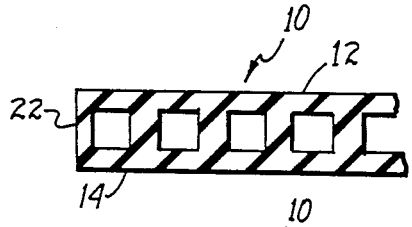
Figure 7B:
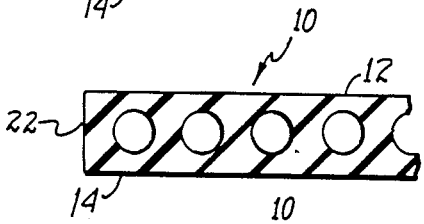
Figure 8C:
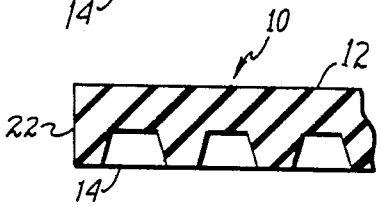

Due to the rigid nature of the recreation surface when the interlocking scheme of the present invention is employed, it may be desirable to use tiles as heretofore described which, in addition, have a peripheral expansion lip 50 as shown in FIG. 6. The expansion lip 50 deforms during thermal expansion of the recreation surface and prevents the surface from buckling.

It will be appreciated by those skilled in the art that many variations in tile configuration and through bore and slot placement are contemplated by the present invention and will be obvious to persons of ordinary skill in the art.

What is claimed is:

1. A rectangular, shock-absorbing tile of substantially uniform overall thickness, defined by upper and lower surfaces and front, rear, left and right side edge surfaces, said tile having first and second through bores each of which communicates with said front and rear side edge surfaces, said first bore being adjacent to and substantially parallel with said left side edge surface, said second bore being adjacent to and substantially parallel with said right side edge surface, said tile also having first and second left side slots and first and second right side slots, each said slot having an upper edge substantially parallel with said upper surface and a lower edge substantially parallel with said lower surface, said first left side slot being adjacent to, spaced from and substantially parallel with said front side edge surface and extending from said left side edge surface a distance sufficient to intersect said first bore, said second left side slot being adjacent to, spaced from and substantially parallel with said rear side edge surface and extending from said left side edge surface a distance sufficient to intersect said first bore, said first right side slot being adjacent to, spaced from and substantially parallel with said front side edge surface and extending from said right side edge surface a distance sufficient to intersect said second bore, said second right side slot being adjacent to, spaced from and substantially parallel with said rear side edge surface and extending from said right side edge surface a distance sufficient to intersect said second bore.

2. The tile as claimed in claim 1 wherein said upper edge of each said slot is spaced substantially below said upper surface to provide a substantial thickness of resilient material therebetween.

3. The tile as claimed in claim 2 wherein said bottom edge of each said slot is open to said bottom surface of said tile.

4. A recreation surface comprising:

(a) a plurality of rectangular, shock-absorbing tiles of predetermined thickness, each said tile defined by upper and lower surfaces and front, rear, left and right side edge surfaces, each of said tiles having first and second molded-through bores each of which communicates with said front and rear side edge surfaces, said first bore is adjacent to and substantially parallel with said left side edge surface, said second bore is adjacent to and substantially parallel with said right side edge surface, each of said tiles also having first and second left side slots and first and second right side slots, said first left side slot is adjacent to, spaced from and substantially parallel with said front side edge surface and extends from said left side edge surface a distance sufficient to intersect said first bore, said second left side slot is adjacent to, spaced from and substantially parallel with said rear side edge surface and extends from said left side edge surface a distance sufficient to intersect said first bore, said first right side slot is adjacent to, spaced from and substantially parallel with said front side edge surface and extends from said right side edge surface a distance sufficient to intersect said second bore, said second right side slot is adjacent to, spaced from and substantially parallel with said rear side edge surface and extends from said right side edge surface a distance sufficient to intersect said second bore, said tiles arranged in a two-dimensional array of perpendicularly directed columns and rows in closely adjacent, edge-to-edge abutting relationship such that in each said column all of said first and second bores in each said tile in said column are aligned with each other to form first and second continuous bores which extend the length of said column and such that in each said row said first and second left side slots of each said tile are in confronting, abutting relationship with said first and second right side slots, respectively, of an abutting tile in said row and said first and second right side slots of each said tile are in confronting, abutting relationship with said first and second left side slots, respectively, of an abutting tile in said row;

(b) a plurality of generally rectangular tie bars each having a first and second aperture therein, each said tie bar disposed in a respective pair of confronting left and right side slots of adjacent tiles in each said row such that said first aperture is aligned with said first bore and said second aperture is aligned with said second bore; and (c) a plurality of elongated tie rods disposed in a spaced parallel array, one said tie rod extending through each said first and second continuous bore in each said column and passing through each respective aperture in each said tie bar, to inhibit movement of the tiles in said array relative to each other in three mutually orthogonal directions parallel to said row and column directions and perpendicular to said array.

* * * * *